United States Patent [19]

Jossens

[11] Patent Number: 4,615,793

[45] Date of Patent: Oct. 7, 1986

[54] HIGH DENSITY RECYCLE GAS FOR REFORMING PROCESS

[75] Inventor: Lawrence W. Jossens, Berkeley, Calif.

[73] Assignee: Chevron Research Company, San Francisco, Calif.

[21] Appl. No.: 579,742

[22] Filed: Feb. 13, 1984

[51] Int. Cl.[4] ..... C10G 35/06

[52] U.S. Cl. ..... 208/138; 208/135

[58] Field of Search ..... 208/138

[56] References Cited

U.S. PATENT DOCUMENTS 3,397,137 8/1968 Pickert et al. ..... 208/138
3,556,986 1/1971 Beck et al. ..... 208/134
3,783,123 1/1974 Young ..... 208/254 H
4,325,808 4/1982 Kim et al. ..... 208/65

FOREIGN PATENT DOCUMENTS 895280 3/1972 Canada .

*Primary Examiner*—Curtis R. Davis
*Attorney, Agent, or Firm*—S. R. LaPaglia; E. A. Schaal; P. L. McGarrigle, Jr.

[57] ABSTRACT

A hydrocarbon feed is contacted with a reforming catalyst in a reaction vessel to produce a reformate, hydrogen, methane, and ethane are stripped from the reformate in a first separator, $C_3$–$C_5$ hydrocarbons are stripped from the stripped reformate in a second separator, and then a portion of the hydrogen, methane, and ethane; and substantially all of the $C_3$–$C_5$ hydrocarbons are recycled to the reaction vessel as heat carrier.

18 Claims, 1 Drawing Figure

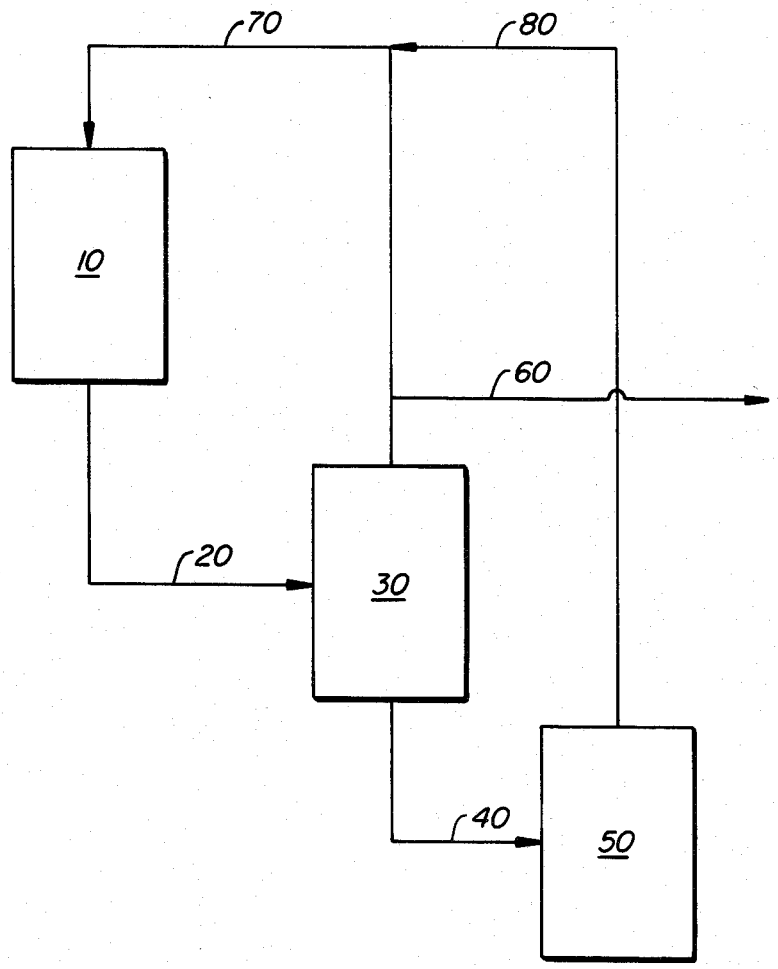
70
80
10
60
20
30
40
50

HIGH DENSITY RECYCLE GAS FOR REFORMING PROCESS

BACKGROUND OF THE INVENTION

The present invention concerns a method of forming a high density recycle gas for a reforming process.

Catalytic reforming is well known in the petroleum industry. It involves treating naphtha fractions to improve the octane rating by producing aromatics. The hydrocarbon reactions occurring during reforming operation include dehydrogenation of cyclohexanes to aromatics, dehydroisomerization of alkylcyclopentanes to aromatics, dehydrocyclization of acylic hydrocarbons to aromatics, dealkylation of alkylbenzenes, isomerization of paraffins, and hydrocracking reactions which produce light gaseous hydrocarbons, e.g., methane, ethane, propane and butanes. Hydrocracking reactions should be minimized during reforming as they decrease both the yield of products in the gasoline boiling range and the yield of hydrogen.

Because of the demand for high octane gasoline for use in motor fuels, extensive research is being devoted to developing improved reforming catalysts and catalytic reforming processes. Catalysts for reforming processes must be able to produce high yields of liquid products in the gasoline boiling range and low yields of light gaseous hydrocarbons. The catalysts should possess good activity in order that low temperatures can be used to produce a quality product. The catalysts should also either possess good stability, in order that the activity and selectivity characteristics can be retained during prolonged periods of operation, or be sufficiently regenerable to allow frequent regeneration without loss of performance.

Catalysts comprising platinum, for example, platinum and rhenium supported or alumina, are widely used for the reforming of naphthas.

Some have proposed the use of certain molecular sieves such as X and Y zeolites, which have pores large enough for hydrocarbons in the gasoline boiling range to pass through. However, reforming catalysts based upon these molecular sieves have not been commercially successful.

In conventional reforming, the hydrocarbons to be converted are passed over the catalyst, in the presence of hydrogen, at temperatures of about 450° C. to 550° C. and pressures of about 50 to 500 psig. Part of the hydrocarbons are converted into aromatic hydrocarbons, and the reaction is accompanied by isomerization and cracking reactions which also convert the paraffins into isoparaffins and lighter hydrocarbons.

The catalysts hitherto used have given fairly satisfactory results with heavy paraffins, but less satisfactory results with $C_6$–$C_8$ paraffins, particularly $C_6$ paraffins. Catalysts based on a type L zeolite are more selective with regard to the dehydrocyclization reaction and produce excellent results with $C_6$–$C_8$ paraffins.

A characteristic of reforming reactions is that there is a temperature drop as the reaction takes place which is proportional to the overall heat of reaction, proportional to conversion, and inversely proportional to the overall heat capacity per unit of reactants. Therefore, in those cases where the reformer is operated to produce a high yield of aromatics it would be advantageous to add a heat carrier to the reformer feed, so that the overall heat capacity per unit of reactant gas would increase and the temperature drop for a targeted maximum conversion would decrease. Decreasing the temperature drop would allow operation with a lower reactor inlet temperature.

SUMMARY OF THE INVENTION

In the present invention, a hydrocarbon feed is contacted with a reforming catalyst in a reaction vessel to produce a reformate, then hydrogen and methane are stripped from the reformate in a first separator and $C_3$–$C_5$ hydrocarbons are stripped from the stripped reformate in a second separate at a higher temperature than the first separator. Then a portion of the hydrogen and methane and substantially all of the $C_3$–$C_5$ hydrocarbons are recycled to the reaction vessel as heat carrier. Preferably, from 1 to 3 moles of $C_3$–$C_5$ hydrocarbons is recycled per mole of feed. This heat carrier increases the heat capacity per unit of reactant, and allows a higher conversion for the same reaction temperature.

BRIEF DESCRIPTION OF THE DRAWING

The appended drawing is supplied as an aid to the understanding of this invention. This drawing is only exemplary, and it should not be construed as limiting the invention. The drawing is a block diagram representation of one embodiment of the present invention.

DESCRIPTION OF THE PREFERRED EMBODIMENTS

Referring to the drawing, the present invention involves contacting a hydrocarbon feed with a reforming catalyst in a reaction vessel 10 to produce a reformate, passing the reformate via line 20 to a first separator 30, stripping a first fraction from said reformate in the first separator 30, passing the stripped reformate via line 40 to a second separator 50, stripping a second fraction from said stripped reformate in the second separator 50, and recycling at least a portion of said first fraction and substantially all of said second fraction to the reaction vessel 10 as heat carrier.

In the first separator 30, a first fraction, comprising hydrogen, methane, and ethane is stripped from the reformate. Part of this first fraction is removed via line 60 as net gas, and the rest is recycled to the reaction vessel 10 via line 70.

In the second separator 50, a second fraction, comprising $C_3$–$C_5$ hydrocarbons, is stripped from the reformate. Substantially all of the second fraction is recycled to the reaction vessel via line 80. From 1 to 3 moles of $C_3$–$C_5$ hydrocarbons are recycled per mole of feed. Preferably, the temperature of the second separator is between 20° and 80° F. greater than the temperature of the first separator.

Feedstock

The feedstock used in the present invention is a naphtha boiling in the gasoline range, containing at least some acyclic hydrocarbons or alkylcyclopentanes.

Preferably, the feedstock is substantially free of sulfur, nitrogen, metals, and other known poisons for reforming catalysts. The feedstock can be made substantially free of known poisons by conventional hydrofining techniques, followed by sorbents that remove the remaining sulfur compounds.

Reforming Reaction

According to the present invention, the hydrocarbon feed is contacted with the pretreated catalyst in a fixed bed system, a moving bed system, a fluidized system, or in a batch-type operation. In view of the danger of attrition losses of the valuable catalyst, it is preferred to use either a fixed bed system or a dense-phase moving bed system. In a fixed bed system, the hydrocarbon feed and recycle gas stream are preheated by any suitable heating means to the desired reaction temperature and then passed into a reforming zone containing a fixed bed of the catalyst. The reforming zone may be one or more separate reactors with suitable means therebetween to ensure that the desired conversion temperature is maintained at the entrance to each reactor. The reactants may be contacted with the catalyst bed in either upward, downward, or radial flow fashion.

Ordinarily, hydrogen is utilized in amounts sufficient to insure a hydrogen to hydrocarbon mole ratio of about 0 to about 20:1, with best results obtained in the range of about 1:1 to about 6:1. The hydrogen charged to the reforming zone will typically be contained in a hydrogen-rich gas stream recycled from the effluent stream from this zone after a suitable gas/liquid separation step.

The reaction conditions include a reactor pressure of from 1 atmosphere to 500 psig, with the preferred pressure being from 50 psig to 200 psig. The temperature is preferably from 450° C. to 550° C. Ordinarily, the temperature is slowly increased during the run to compensate for the inevitable deactivation that occurs to provide a relatively constant value for conversion.

The liquid hourly space velocity (LHSV) is from 0.1 to 10 $hr.^{-1}$, with a value of from 0.3 to 5 $hr.^{-1}$ being preferred.

Reforming generally results in the production of hydrogen. Thus, hydrogen usually need not be added to the reforming system except for pre-reduction of the catalyst and when the feed is first introduced. Generally, once reforming is underway, part of the hydrogen produced is recirculated over the catalyst. The presence of hydrogen serves to reduce the formation of coke which tends to poison the catalyst.

The reforming catalyst according to the invention is a large-pore zeolite charged with one or more dehydrogenating constituents. The term "large-pore zeolite" is defined as a zeolite having an effective pore diameter of 6 to 15 Angstroms.

Type L zeolite, zeolite X, zeolite Y and faujasite are thought to be the best large-pore zeolites for this operation and have apparent pore sizes on the order of from 7 to 9 Angstroms. Type L zeolite is described in U.S. Pat. No. 3,216,789. Zeolite X is described in U.S. Pat. No. 2,882,244. Zeolite Y is described in U.S. Pat. No. 3,130,007. U.S. Patent Nos. 3,216,789; 2,882,244; and 3,130,007 are hereby incorporated by reference to show zeolites useful in the present invention.

The preferred catalyst according to the invention is a type L zeolite charged with one or more dehydrogenating constituents.

Alkaline Earth Metals

A possible element of the present invention is the presence of an alkaline earth metal in the catalyst. That alkaline earth metal can be either barium, strontium or calcium. Preferably the alkaline earth metal is barium. The alkaline earth metal can be incorporated into the zeolite by synthesis, impregnation or ion exchange. Barium is preferred to the other alkaline earths because the resulting catalyst has high activity, high selectivity and high stability.

In one embodiment, at least part of the alkali metal is exchanged with barium, using techniques known for ion exchange of zeolites. This involves contacting the zeolite with a solution containing $Ba^{++}$ ions preferably in excess of the zeolite exchange capacity. The barium should preferably constitute from 0.1% to 35% of the weight of the zeolite, more preferably from 1% to 20% by weight.

Group VIII Metals

The reforming catalysts according to the invention are charged with one or more Group VIII metals, e.g., nickel, ruthenium, rhodium, palladium iridium or platinum.

The preferred Group VIII metals are iridium and particularly platinum, which are more selective with regard to dehydrocyclization and are also more stable under the reforming reaction conditions than other Group VIII metals. The preferred percentage of platinum in the catalyst is between 0.1% and 5%, more preferably from 0.2% to 1.0%.

Group VIII metals are introduced into the zeolite by synthesis, impregnation or exchange in an aqueous solution of an appropriate salt. When it is desired to introduce two Group VIII metals into the zeolite, the operation may be carried out simultaneously or sequentially.

By way of example, platinum can be introduced by impregnating the zeolite with an aqueous solution of tetrammineplatinum (II) nitrate, tetrammineplatinum (II) hydroxide, dinitrodiamino-platinum or tetrammineplatinum (II) chloride. In an ion exchange process, platinum can be introduced by using cationic platinum complexes such as tetrammineplatinum (II) nitrate.

Catalyst Pellets

An acidic or acidifiable inorganic oxide can be used as a carrier to bind the large pore size zeolite, to make the catalyst more selective and active for isomerization and dehydroisomerization, and to give the catalyst additional strength. The carrier can be a natural or a synthetically produced inorganic oxide or combination of inorganic oxides. Preferred loadings of inorganic oxide are from 5% to 50% by weight of the catalyst. Typical acidic inorganic oxide supports which can be used include silica-alumina, zirconia-silica and halogenated or halogenateable alumina.

It may be desirable to exchange the zeolite with an alkaline earth metal before binding the zeolite with a binder so that the catalyst is subjected to a minimum of exchangeable cations after it is bound. This could make the binder more amenable to effective chloriding than if it were substantially contaminated with alkali or alkaline earth metal ions.

In one embodiment, the zeolite is made, then the zeolite is ion exchanged with a barium solution, separated from the barium solution, dried and calcined, impregnated with platinum, dried, calcined, and optionally reduced in hydrogen at about 900° F., and then mixed with the inorganic oxide and extruded through a die to form cylindrical pellets, then the pellets are dried and calcined.

In another embodiment, the large-pore zeolite is mixed with the inorganic oxide and extruded through the die to form cylindrical pellets, then the pellets are dried and calcined, then these pellets are ion exchanged with a barium solution, separated from the barium solution, dried and calcined, impregnated with platinum, separated from the platinum solution, dried and calcined.

While the present invention has been described with reference to specific embodiments, this application is intended to cover those various changes and substitutions which may be made by those skilled in the art without departing from the spirit and scope of the appended claims.

What is claimed is:

1. A reforming process comprising:

(a) contacting a hydrocarbon feed with a monofunctional, reforming catalyst, comprising a large pore zeolite and a Group VIII metal, in a reaction vessel to produce a reformate;

(b) stripping a first fraction from said reformate in a first separator;

(c) stripping a second fraction from said stripped reformate in a second separator; and (d) recycling a portion of said first fraction and substantially all of said second fraction to said reaction vessel as a heat carrier so that said first and second fractions may assist in maintaining the heat within the reaction vessel above the point at which the reaction will be extinguished.

2. A reforming process according to claim 1 wherein said first fraction comprises hydrogen, methane, and ethane, and wherein said second fraction comprises $C_3$–$C_5$ hydrocarbons.

3. A reforming process according to claim 1 wherein said reforming catalyst comprises a large-pore zeolite containing at least one Group VIII metal.

4. A reforming process comprising:

(a) contacting a hydrocarbon feed with a reforming catalyst in a reaction vessel to produce a reformate, wherein said reforming catalyst comprises a large-pore zeolite containing at least one Group VIII metal;

(b) stripping a hydrogen, methane, and ethane fraction from said reformate in a first separator;

(c) stripping a $C_3$–$C_5$ hydrocarbons fraction from said stripped reformate in a second separator; and (d) recycling a portion of said hydrogen, methane, and ethane fraction and substantially all of said $C_3$–$C_5$ hydrocarbons fraction to said reaction vessel as a heat carrier so that both of said fractions may assist in maintaining the heat within the reaction vessel above the point at which the reaction will be extinguished.

5. A reforming process according to claim 4 wherein the temperature of the second separator is greater than the temperature of the first separator.

6. A reforming process according to claim 5 wherein the temperature of the second separator is between 20° and 80° greater than the temperature of the first separator.

7. A reforming process according to claim 4 wherein from 1 to 3 moles of $C_3$–$C_5$ hydrocarbons are recycled per mole of feed.

8. A reforming process according to claim 4 wherein said large-pore zeolite has an apparent pore size of from 7 to 9 Angstroms.

9. A reforming process according to claim 8 wherein said large-pore zeolite is selected from the group consisting of zeolite X, zeolite Y and type L zeolite.

10. A reforming process according to claim 9 wherein said large-pore zeolite is a type L zeolite.

11. A reforming process according to claim 4 wherein said Group VIII metal is platinum.

12. A reforming process according to claim 4 wherein said catalyst contains an alkaline earth metal selected from the group consisting of barium, strontium, and calcium.

13. A reforming process according to claim 12 wherein said alkaline earth metal is barium and wherein said Group VIII metal is platinum.

14. A reforming process according to claim 13 wherein said catalyst has from 8% to 10% by weight barium and from 0.2% to 1.0% by weight platinum.

15. A reforming process according to claim 14 wherein said catalyst comprises:

(a) a large-pore zeolite containing platinum; and (b) an inorganic binder.

16. A reforming process according to claim 15 wherein said inorganic binder is selected from the group consisting of silica, alumina, and aluminosilicates.

17. A reforming process comprising:

(a) contacting a hydrocarbon feed with a reforming catalyst in a reaction vessel to produce a reformate, wherein said reforming catalyst comprises:

(1) a type L zeolite containing from 0.2% to 1.0% by weight platinum; and (2) an inorganic binder selected from the group consisting of silica, alumina, and aluminosilicates;

(b) stripping a hydrogen, methane, and ethane fraction from said reformate in a first separator;

(c) stripping a $C_3$–$C_5$ hydrocarbons fraction from said stripped reformate in a second separator, wherein the temperature of the second separator is between 20° and 80° F. greater than the temperature of the first separator;

(d) recycling a portion of said hydrogen, methane, and ethane fraction and substantially all of said $C_3$–$C_5$ hydrocarbons fraction to said reaction vessel, wherein from 1 to 3 moles of $C_3$–$C_5$ hydrocarbons are recycled per mole of feed; and (e) maintaining the heat level within the reactor above a level in which the reaction would be extinguished.

18. A reforming process comprising:

(a) contacting a hydrocarbon feed with a reforming catalyst in a reaction vessel to produce a reformate, wherein said reforming catalyst comprises:

(1) a type L zeolite containing from 8% to 10% by weight barium and from 0.2% to 1.0% by weight platinum;

(2) an inorganic binder selected from the group consisting of silica, alumina, and aluminosilicates;

(b) stripping a hydrogen, methane, and ethane fraction from said reformate in a first separator;

(c) stripping a $C_3$–$C_5$ hydrocarbons fraction from said stripped reformate in a second separator, wherein the temperature of the second separator is between 20° and 80° F. greater than the temperature of the first separator;

(d) recycling a portion of said hydrogen, methane, and ethane fraction and substantially all of said $C_3$–$C_5$ hydrocarbons fraction to said reaction vessel, wherein from 1 to 3 moles of $C_3$–$C_5$ hydrocarbons are recycled per mole of feed; and (e) maintaining the heat level within the reactor above a level in which the reaction would be extinguished.

* * * * *

UNITED STATES PATENT AND TRADEMARK OFFICE

CERTIFICATE OF CORRECTION

PATENT NO. : 4,615,793

DATED : October 7, 1986

INVENTOR(S) : Lawrence W. Jossens

It is certified that error appears in the above-identified patent and that said Letters Patent are hereby corrected as shown below:

Col. 5, line 56, "80°" should read --80°F--.

Col. 6, line 13, "Claim 14" should read --Claim 4--.

Signed and Sealed this

Thirtieth Day of December, 1986

*Attest:*

DONALD J. QUIGG

*Attesting Officer*

*Commissioner of Patents and Trademarks*